US007546717B2

(12) United States Patent
Juan Puerta

(10) Patent No.: US 7,546,717 B2
(45) Date of Patent: Jun. 16, 2009

(54) TIMBER COVERING FOR EXTERIORS AND INTERIORS

(75) Inventor: José Juan Puerta, Barcelona (ES)

(73) Assignee: Complepark, S.L., Barcelona (ES)

( * ) Notice: Subject to any disclaimer, the term of this patent is extended or adjusted under 35 U.S.C. 154(b) by 0 days.

(21) Appl. No.: 11/464,849

(22) Filed: Aug. 16, 2006

(65) Prior Publication Data

US 2006/0283126 A1 Dec. 21, 2006

Related U.S. Application Data

(63) Continuation of application No. PCT/ES2005/000091, filed on Feb. 28, 2005.

(30) Foreign Application Priority Data

Mar. 3, 2004 (ES) ..... 200400507

(51) Int. Cl.
*E04B 2/00* (2006.01)

(52) U.S. Cl. ..... 52/586.1; 52/302.1; 52/588.1; 52/589.1

(58) Field of Classification Search ..... 52/586.1, 52/588.1, 589.1, 582.1, 302.1
See application file for complete search history.

(56) References Cited

U.S. PATENT DOCUMENTS

| | | | | | |
|---|---|---|---|---|---|
| 2,038,433 | A | | 4/1936 | Lawrence, Jr. | |
| 3,267,630 | A | | 8/1966 | Omholt | |
| 3,331,180 | A | * | 7/1967 | Vissing et al. | 52/714 |
| 3,577,694 | A | * | 5/1971 | Omholt | 52/506.1 |
| 4,170,859 | A | * | 10/1979 | Counihan | 52/779 |
| 4,333,286 | A | * | 6/1982 | Weinar | 52/281 |
| 4,448,007 | A | * | 5/1984 | Adams | 52/489.2 |
| 4,777,778 | A | * | 10/1988 | Taupin | 52/714 |
| 4,782,642 | A | * | 11/1988 | Conville | 52/770 |
| 4,819,932 | A | | 4/1989 | Trotter, Jr. | |
| 5,590,502 | A | * | 1/1997 | Wendt | 52/489.2 |

FOREIGN PATENT DOCUMENTS

| | | |
|---|---|---|
| ES | 1041505 | 7/1999 |
| FR | 2750462 | 1/1998 |
| GB | 365751 | 1/1932 |
| GB | 431605 | 7/1935 |
| GB | 2167465 | 5/1986 |

* cited by examiner

*Primary Examiner*—Basil Katcheves
(74) *Attorney, Agent, or Firm*—Darby & Darby, P.C.

(57) ABSTRACT

The covering comprises a large number of strips of timber fixed by means of clips or other components to a supporting framework fixed to the surface to be covered and is characterized in that the edges of the greater sides of the strips are partially asymmetrical, having an arrangement of mating projections and recesses and being capable of engaging in one another while leaving an intermediate gap and in such a way that the projecting upper edge of one of the profiles overlaps mating projections of the adjacent strip situated therebelow, preventing the base on which is fixed the covering or the accessories for the fixing thereof from being seen from the visible face of the covering.

14 Claims, 10 Drawing Sheets

TIMBER COVERING FOR EXTERIORS AND INTERIORS

CROSS-REFERENCE TO RELATED APPLICATIONS

This application is a Continuation of International Application No. PCT/ES2005/000091, filed Feb. 28, 2005, which claims priority to Spanish Application No. P200400507 filed Mar. 3, 2004, which is hereby incorporated by reference in its entirety.

DESCRIPTION

The present invention relates to a timber covering for exteriors and interiors which has significant characteristics of novelty and inventive step.

Timber coverings for exteriors and interiors are known, which are intended to provide a surface which is more attractive than that found in some cases and formed merely by general constructional coverings, such as cement or concrete coverings, or slabs with an unattractive finish or structural top slabs. Said timber coverings are placed on the top slab or original covering using a type of boarding which involves the provision of a supporting, levelling framework and a large number timber components, basically in the form of flattened strips in a transverse or longitudinal disposition arranged in parallel with slight spacing so as to produce a finish of much better quality. The timber components are normally produced from timbers which are resistant to the environment so that the resulting flooring requires far less maintenance.

There should be a specific gap between the strips forming the timber covering to allow the passage of rainwater or cleaning water toward the original covering, which will have a conventional drainage means. However, the need to provide said gaps between strips is detrimental to the appearance, so users of the covering see, through said gaps, unattractive components of the original covering or components for fixing the strips to the supporting framework, for example the clips which are conventionally fixed to the supporting framework and which, when mating with grooves in the strips, allow the positioning and centring thereof.

On the other hand, the present invention protects, to a greater extent, the anchoring parts such as supporting battens, clips and screws from damage caused by the passage of time and, moreover, they are easy to clean since they do not allow the passage of small impurities such as twigs, flowers, leaves, pieces of paper, etc.

Another additional advantage of the timber covering for exteriors and interiors according to the present invention is that, if it is used for covering walls and roofs it allows the wall to be left with a rough finish, as the base on which it is mounted cannot be seen through the covering, this representing a saving in time and cost.

The invention is defined by the contents of claim 1. Claims 2 to 8 relate to specific embodiments of the invention.

The timber covering according to the present invention is characterised in that it achieves the aforementioned objects in that the mutually opposed lateral edges of the strips have an asymmetrical structure so that one of the edges has a lip or projecting region adjacent to a recessed region, whereas the adjacent strip profile has a shape which mates therewith, in other words a recessed profile which mates with the projecting profile of the first strip and a projecting region or profile which mates with the recessed region of the first strip. This allows assembly of the strips of covering so that they are provided with the necessary play between themselves, which is sufficiently small to allow only the passage of water and, owing to the overlap between the projecting profile of a strip and the adjacent strip, viewing of the floor does not reveal the base, or rear portion thereof, and this is the claimed object.

Therefore, production of the strips in accordance with the present invention will comprise the production of asymmetrical mating profiles in each of the lateral edges of said strips, so as to allow the assembly thereof in the aforementioned manner.

The precise structure of the edges of the strips can vary widely, and merely has to fulfil the characteristics of asymmetry of each of the lateral strips and mutually overlapping disposition.

The accompanying drawings of a preferred embodiment of the invention, given as an explanatory, non-limiting example, will assist understanding thereof.

Figure 1:
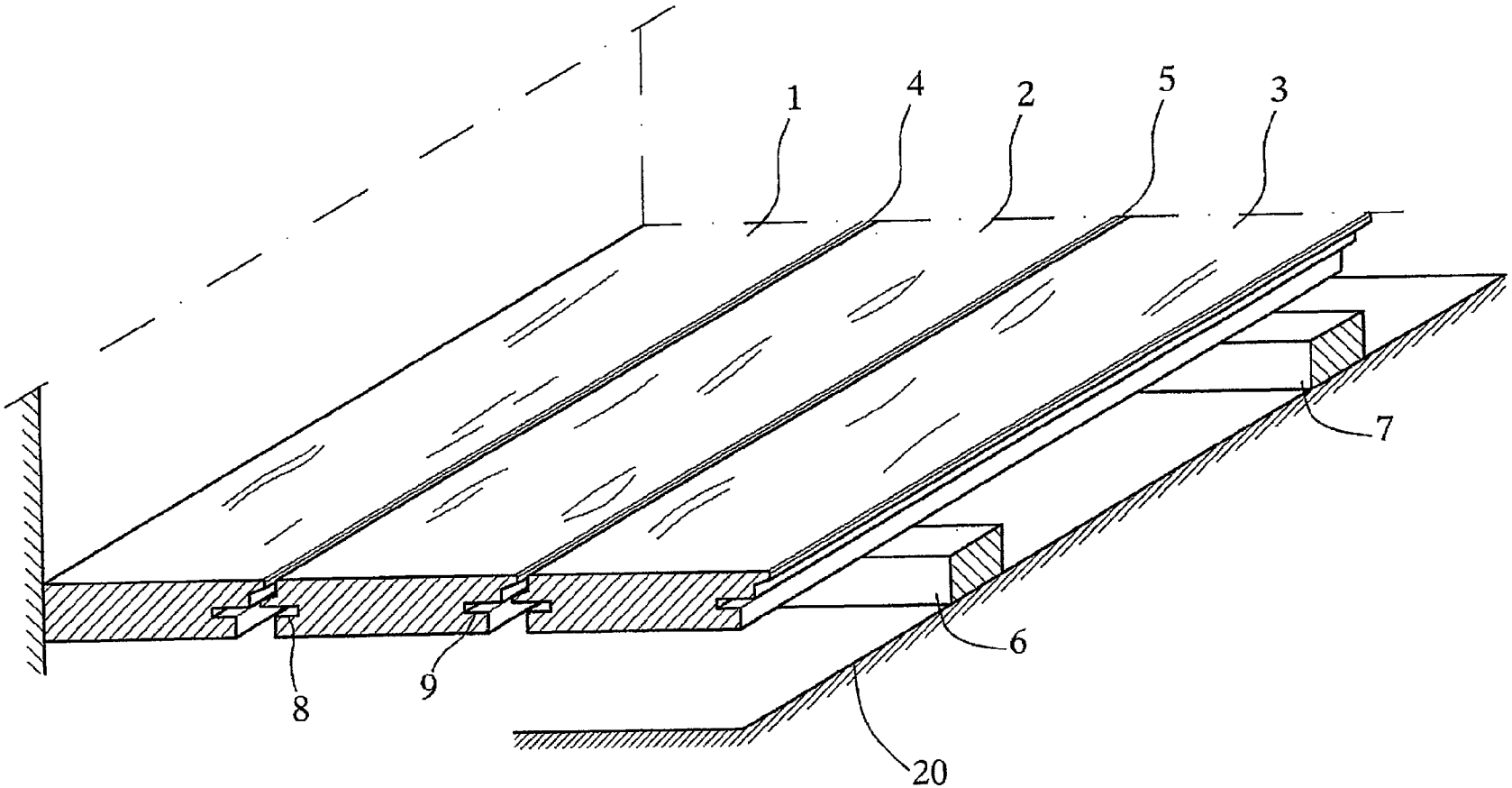
FIG. 1 is a simplified perspective view of an assembly of strips of a timber covering for exteriors and interiors according to the invention.
Figure 2:
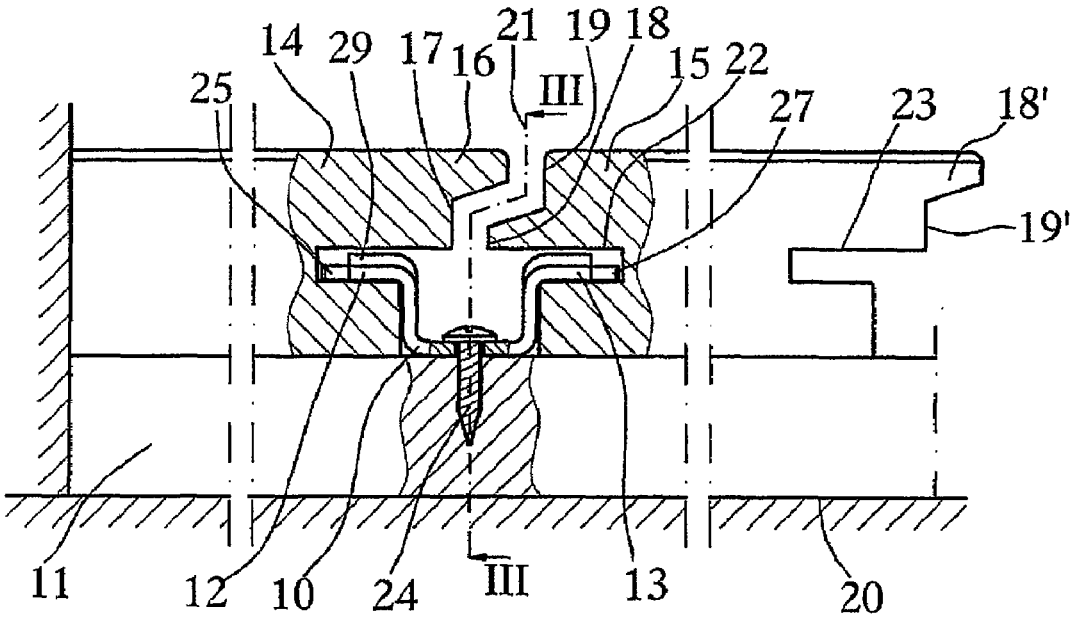
FIG. 2 is a cross section of the covering through the sectional plane indicated in FIG. 1.

As shown in the drawings, the present invention relates to a timber covering for exteriors and interiors which, in FIG. 1, is shown as a surface covering formed by a series of timber strips such as those indicated by reference numerals 1, 2 and 3, disposed in parallel with reduced gaps between each two thereof, such as 4 and 5, and fixed to a supporting framework of which can be seen the longitudinal beams 6 and 7 which have grooves such as the grooves 8 and 9 of the rail 2 intended to fit in the wings of clips for fastening to the framework, as shown in FIG. 2, which illustrates a clip 10 fixed to a cross beam of the support 11 and provided with wings 12 and 13 which are introduced in the grooves of two adjacent strips designated by the reference numerals 14 and 15.

The characteristic of the present invention is that the strips have partially asymmetric mutually opposed edges of mating shape, forming a respective projecting region or wing 16, FIG. 2, which defines a step or recess 17, in such a way that the opposing edge has a substantially mating structure by means of a projecting wing or rib 18 and a recessed region 19 disposed in reverse to the other strip, in other words partially mating with one another so that the projecting profiles 16 and 18 partially overlap so that viewing of the coating from the visible face, which is the upper portion of the covering in the illustrated case, does not reveal the base on which the flooring is mounted, for example the clips 10 or the ground 20 on which the flooring is mounted, etc. Between the two opposing edges of the strips 14 and 15 is a separating gap 21 of reduced size which, although it readily allows the passage of water does not allow the passage of normal impurities such as parts of plants, papers, butts, etc. to facilitate cleaning of the flooring.

In accordance with the present invention, each of the strips will have unequal, partially asymmetric, lateral edges since, although the grooves such as 22 and 23 for introduction of the fastening clips are obviously symmetrical, the upper portions of said edges are asymmetrical, as shown in the drawings, FIG. 2 showing that, although one of the lateral edges is incorporated, in the case of the strip 15, by the projecting region 18 in the lower portion and the recessed region 19 in the upper portion, the projecting wing 18' on the other side is situated on the upper portion and the recessed portion 19' is situated on the lower portion so as to be able to receive the adjacent strip, as illustrated.

Figure 3:
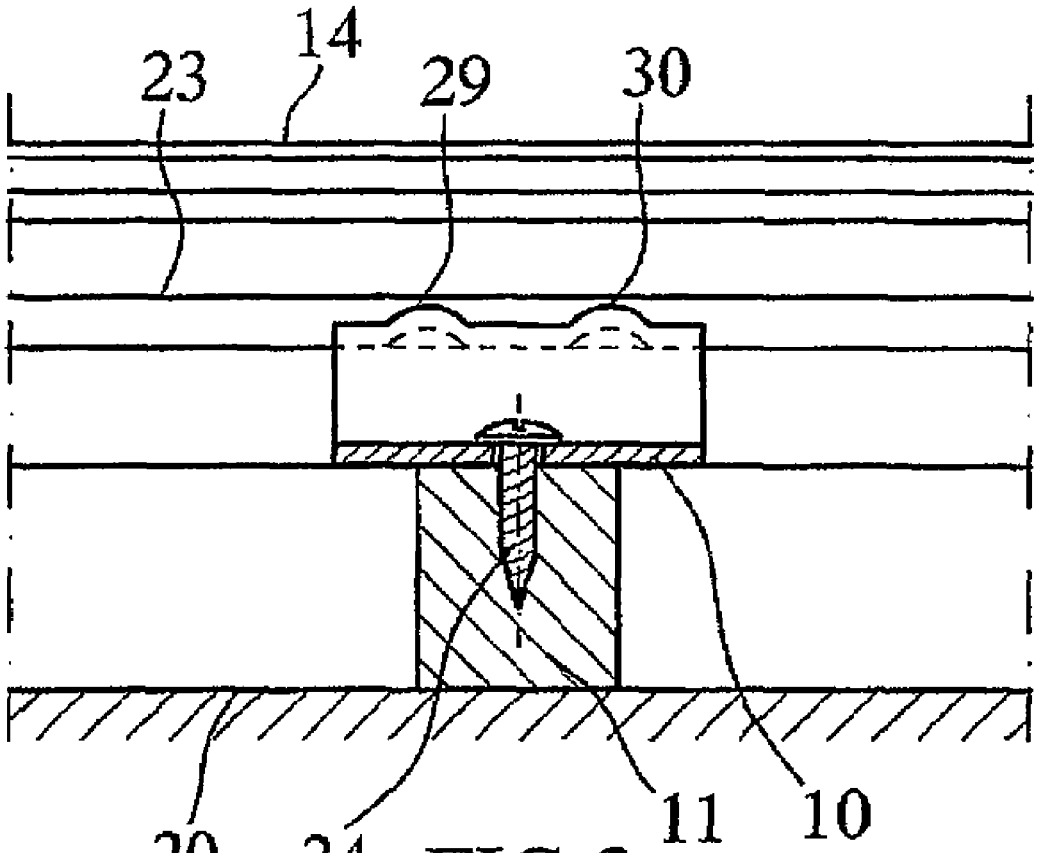
FIG. 3 is a section through the sectional plane indicated in FIG. 2.
Figure 4:
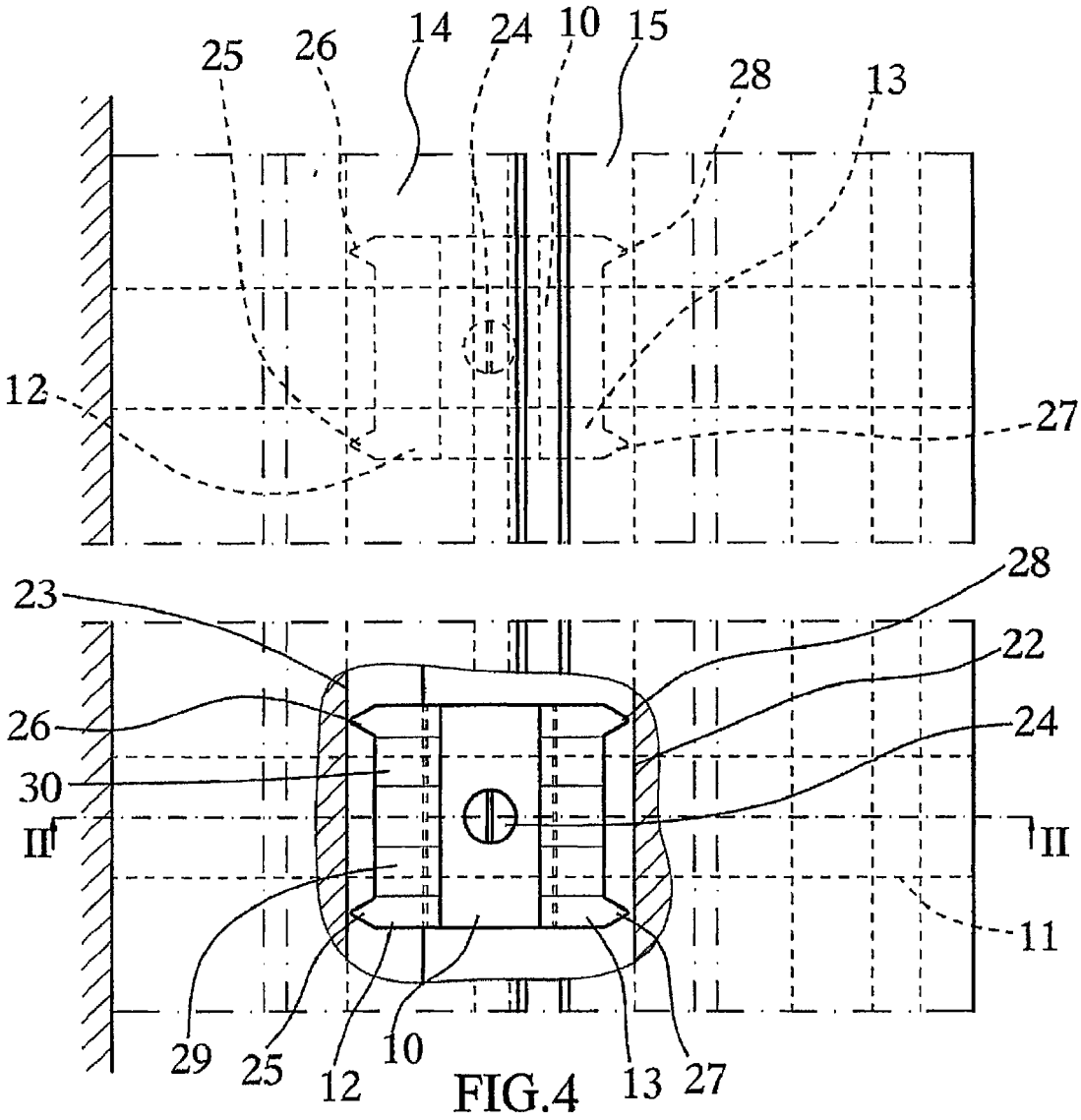
FIG. 4 is a plan view of the covering for exteriors and interiors according to the invention with a partial section.

The present invention also extends to the specific structure of the fastening clips 10, with the object of achieving better centring without play between the strips and the clips, both horizontally and vertically, as shown in particular in FIG. 4. The clip 10 provided with the arms 12 and 13 is fixed by means of screws 24 or other equivalent components to the framework and has, at the external edges of the arms 12 and 13, respective pairs of projecting tips such as 25 and 26, in the case of the arm 12, and 27 and 28 in the case of the arms 13, to reduce to a great extent or suppress the lateral play between the adjacent strips represented by the numerals 13 and 14 in the figure, allowing the lateral play of the strips to be eliminated. With the object of reducing or eliminating play between the strips along the vertical regions thereof, the present invention provides that the arms of the clips have reliefs or domes such as those represented by reference numerals 29 and 30 in FIG. 3, to reduce or eliminate the vertical play of the strip within the grooves for the clips.

As mentioned hereinbefore, the precise shape of the lateral edges of the strips can vary between wide limits, examples being shown in FIGS. 5 to 10.

Figure 5:
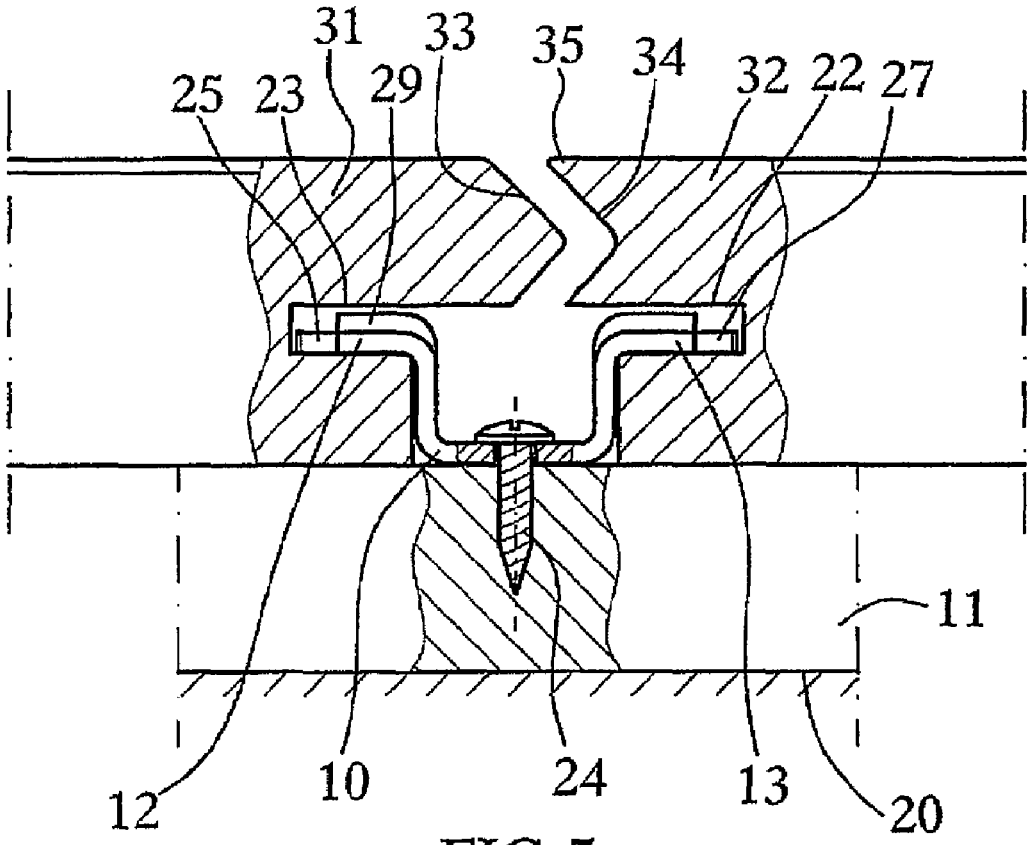
FIGS. 5 to 10 are sections of coverings according to the invention showing alternative embodiments of the edges of the strips.

Thus, for example, in FIG. 5, two adjacent strips 31 and 32 have mating profiles substantially in the form of a projecting 33 and recessed 34 acute angle, which are disposed so as to produce the aforementioned overlap between the upper wing 35 and the vertex of the projection 33 in order to fulfil the characteristics of the present invention.

Figure 6:
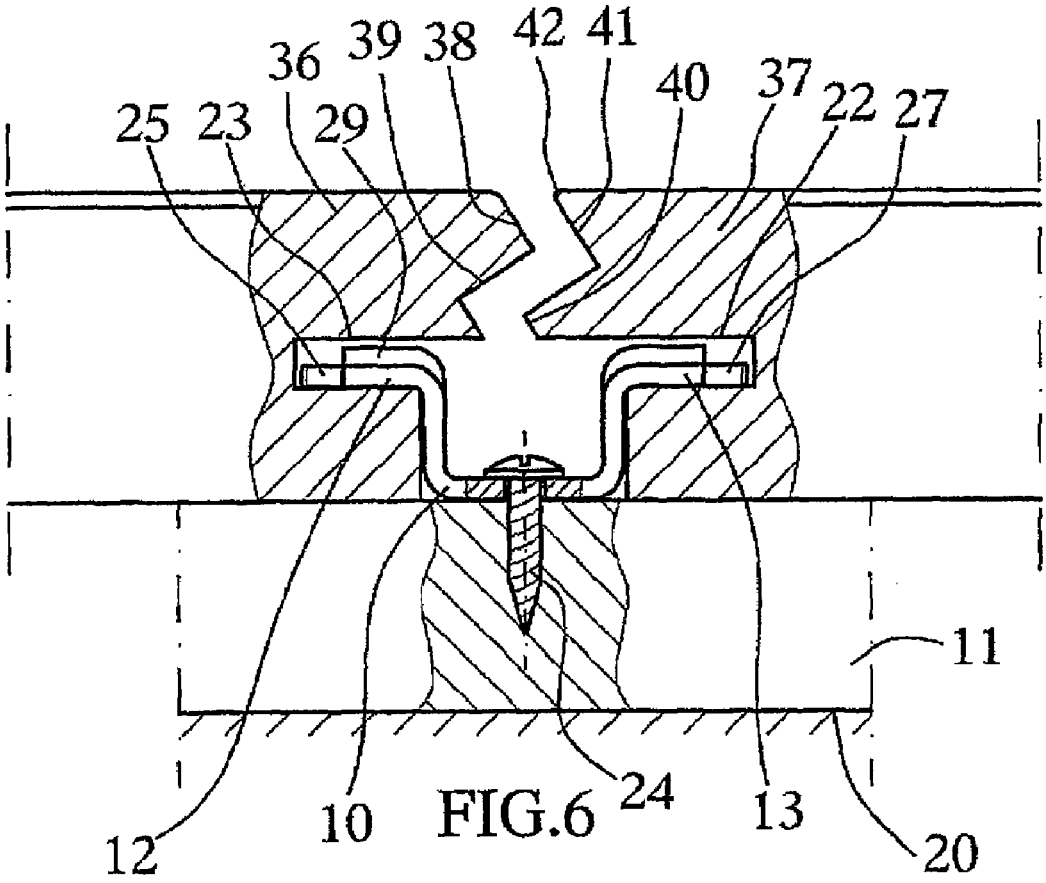

FIG. 6 shows an embodiment in which the strips 36 and 37 have a zigzag profile, in other words a double angle, by means of which each of the edges has a projection and a recess respectively mating with those of the adjacent strip, the projection 38 and recess 39 being shown in the case of the strip 36 and the lower projection 40 and recess 41 in the case of the strip 37, mating with 39 and 38 respectively of the strip 36. In this case also, the upper edge 42 will overlap the projection 38.

Figure 7:
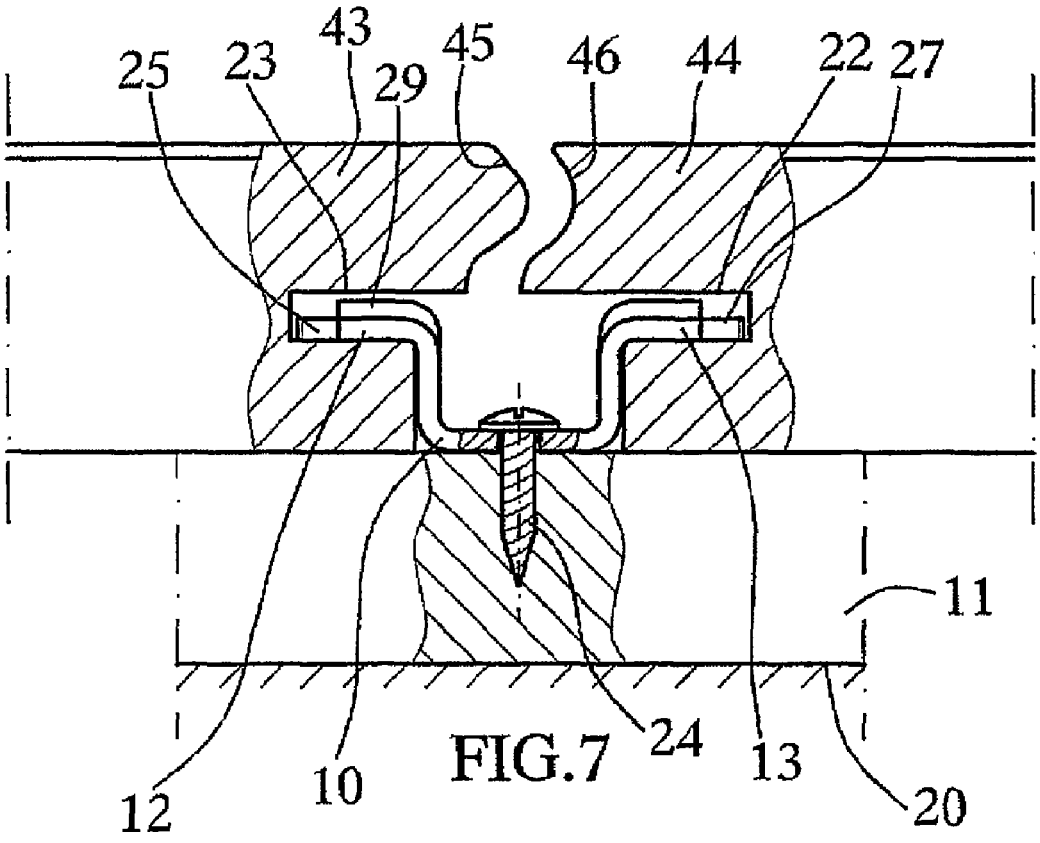

In FIG. 7, the adjacent strips 43 and 44 have mating profiles formed by undulating lines 45 and 46 respectively with the same overlapping characteristics as mentioned hereinbefore.

Figure 8:
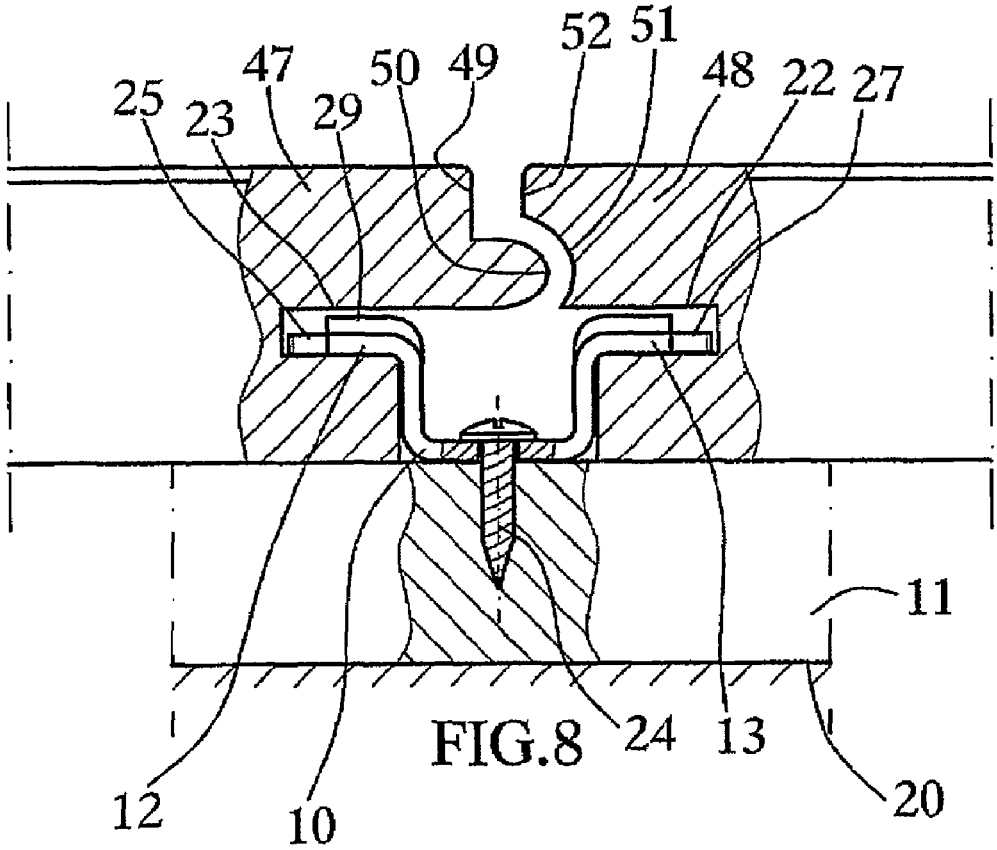

FIG. 8 shows a version in which the strips 47 and 48 have mating profiles on their straight and curved edges, in the first case with a planar surface 49 and a curved projection 50 and in the second case with mating profiles which are concave 51 and planar in the upper portion 52.

Figure 9:
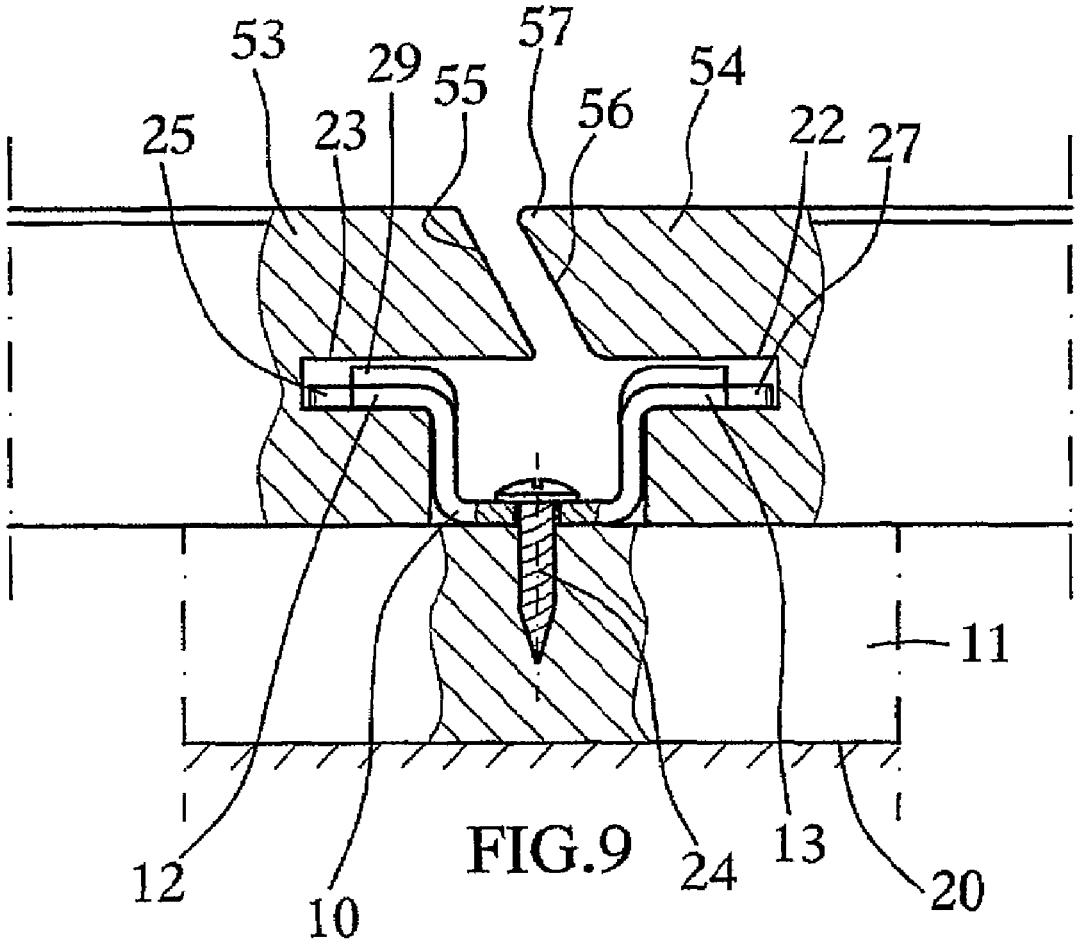

FIG. 9 shows an embodiment in which the mating profiles are simply straight and inclined together, it being shown that the strips 53 and 54 have, on their opposing edges, merely inclined planar regions 55 and 56, the overlap between the upper edge 57 of the strip 54 and the face of the inclined plane 55 being achieved as in the other cases.

Figure 10:
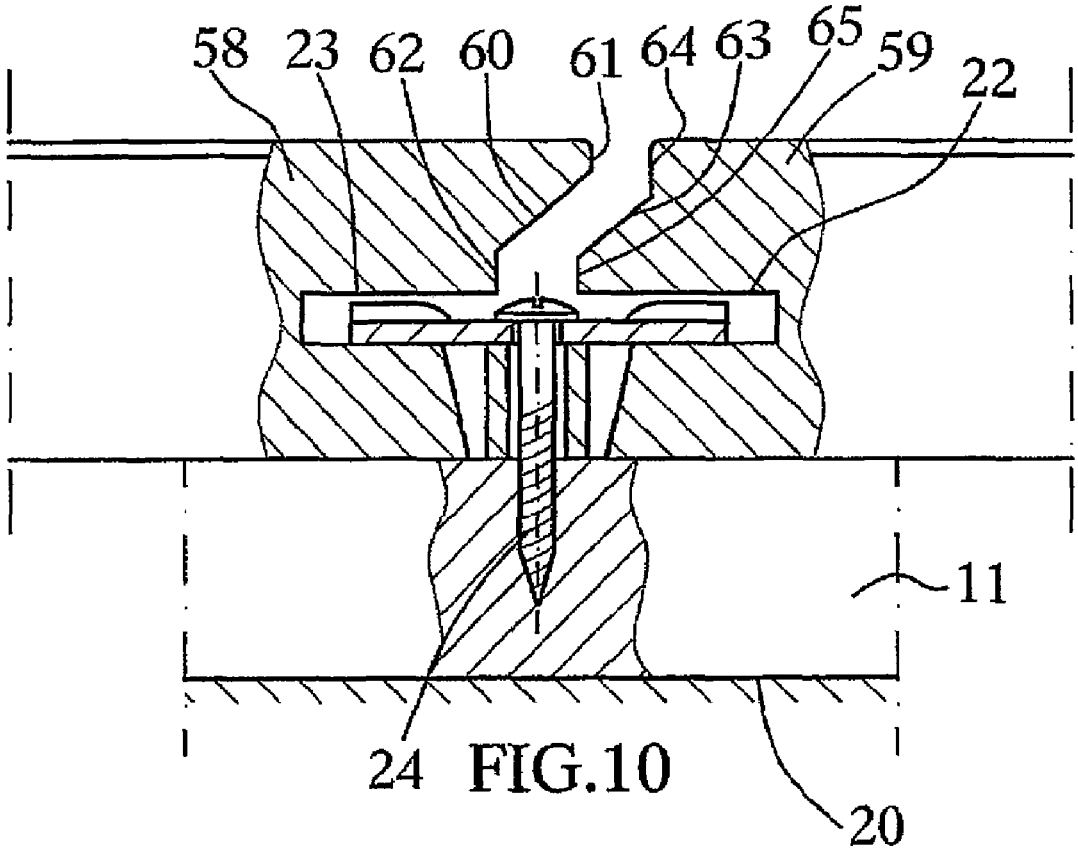

The example of FIG. 10 relates to a profile having mating straight and inclined regions in which the strips 58 and 59 have, on their respective opposing edges, an intermediate inclined plane 60, an upper vertical straight region 61 and a lower vertical straight region 62, whereas the opposing strip has the inclined intermediate plane 63 and upper and lower straight regions 64 and 65 opposing the planes 61 and 62 of the strip 58. As in the other cases, the projecting edge, in other words 61 of the strip 58 will overlap the projecting profile of the planar region 65 of the strip 59.

It will be appreciated that the examples of specific forms of the opposing edges of the strips can vary within wide limits, providing that the basic characteristics of the present invention, which are apparent from the foregoing description and the following claims, are achieved.

It is also obvious that, although the figures show, in particular, embodiments of floor coverings, the same considerations will apply if the covering is used for vertical panels or roofs.

The invention claimed is:

1. A timber covering for exteriors and interiors, the covering comprising:

at least one fastening clip for affixing timber strips to a supporting framework, the framework being fixed to a surface to be covered;

a plurality of strips of timber; the plurality of strips being mutually parallel and disposed in the same plane and comprising grooves in mutually opposed lateral edges for engaging edges of the fastening clip;

wherein the edges of the greater sides of the strips are partially asymmetrical, having an arrangement of mating projections and recesses and being capable of engaging in one another while leaving an intermediate gap in such a way that a projecting upper edge of a profile of a respective strip overlaps mating projections of an adjacent strip situated therebelow, thereby preventing a base on which is fixed the covering or accessories for the fixing thereof from being seen from a visible face of the covering and allowing the passage of water through the intermediate gap to the base.

2. A timber covering for exteriors and interiors according to claim 1, characterised in that one lateral edge of the strip has a projecting upper wing and an adjacent lower recess, while the other edge of the strip has said wing and recess in the reverse position, the projection being located on the lower portion and the recess in the upper portion to allow the mating positioning thereof with another adjacent strip.

3. A timber covering for exteriors and interiors according to claim 1, wherein a lateral of a respective strip correspond to projections and recesses in the form of respective angles of identical value.

4. A timber covering for exteriors and interiors according to claim 1, characterised in that the edges of the strips have sets of curved projections and recesses of mating shape in either edge.

5. A timber covering for exteriors and interiors according to claim 1, characterised in that the edges of the strips comprise inversely inclined planes.

6. A timber covering for exteriors and interiors, the covering comprising:

at least one fastening clip for affixing timber strips to a supporting framework, the framework being fixed to a surface to be covered;

a plurality of timber strips, the plurality of strips being mutually parallel and disposed in the same plane and comprising grooves in mutually opposed lateral edges for engaging edges of the fastening clip;

wherein the edges of the greater sides of the strips are partially asymmetrical, having an arrangement of mating projections and recesses and being capable of engaging in one another while leaving an intermediate gap in such a way that a projecting upper edge of a profile of a respective strip overlaps mating projections of an adjacent strip situated therebelow, thereby preventing a base on which is fixed the covering or the accessories for the fixing thereof from being seen from a visible face of the covering and allowing the passage of water through the intermediate gap to the base, and wherein the fastening clip comprises projecting tips and undulations disposed in a wing of the fastening clip to reduce the play of a corresponding groove of the strips relative to the fastening clip.

7. A timber covering for exteriors and interiors according to claim 6, wherein the wing of the clip comprises projecting tips at the ends.

8. A timber covering for exteriors and interiors according to claim 6, wherein the wing of the clip comprises a pair of domes intended to reduce play within the receiving groove.

9. A timber covering for exteriors and interiors according to claim 6, wherein a respective strip comprises:

one lateral edge having a projecting upper wing and an adjacent lower recess;

a second lateral edge having a projecting lower wing and an adjacent upper recess;

wherein the projecting wings are located on the lower portion and the recesses in the upper portion to allow the mating positioning thereof with another adjacent strip.

10. A timber covering for exteriors and interiors according to claim 6, wherein a lateral profile of a respective strip correspond to projections and recesses in the form of respective angles of identical value.

11. A timber covering for exteriors and interiors according to claim 6, wherein the edges of a respective strip comprise at least one curved projection and a corresponding recess of mating shape.

12. A timber covering for exteriors and interiors according to claim 6, wherein the edges of the strips comprise inversely inclined planes.

13. A timber covering for exteriors and interiors comprising:

a plurality of timber strips, each of the plurality of timber strips comprising:

a first groove disposed on a first side of the timber strip;

a second groove disposed on a second side of the timber strip and opposite to the first groove;

a first projection disposed on the first side of the timber strip;

a first recess disposed on the first side of the timber strip;

a second projection disposed on the second side of the timber strip, the second projection correspondingly shaped to insert into the first recess;

a second recess disposed on the second side of the timber strip, the second recess correspondingly shaped to receive the first projection;

a plurality of fastening clips, each fastening clip being disposed in the first and second grooves of a set of two adjacent timber strips; and an intermediate gap disposed at a junction of the set of two adjacent timber strips for covering a respective fastening clip from being seen from a visible face of the covering and allowing the passage of water.

14. A timber covering for exteriors and interiors according to claim 13, wherein each of the plurality of fastening clips comprise protruding wings disposed on either end;

wherein when a respective fastening clip is affixed between two adjacent timber strips, an open space between a top surface of a support and a bottom surface of the projections and recesses is created; and wherein the intermediate gap is situated directly above the open space so as to allow for maximum water passage.

* * * * *